United States Patent [19]

Jones et al.

[11] 4,103,444

[45] Aug. 1, 1978

[54] FLAP POP-UP FOR ADVERTISING LEAFLETS

[75] Inventors: John H. Jones, Westfield; Donald W. Schoenleber, Princeton; Frederick Grainger, Green Brook, all of N.J.

[73] Assignee: Beatrice Foods Co., Chicago, Ill.

[21] Appl. No.: 754,363

[22] Filed: Dec. 27, 1976

[51] Int. Cl.[2] ..... G09F 1/00

[52] U.S. Cl. ..... 40/124.1; 46/34

[58] Field of Search ..... 40/124.1, 126 A, 34; 46/34

[56] References Cited

U.S. PATENT DOCUMENTS

| | | | |
|---|---|---|---|
| 1,844,816 | 2/1932 | Brown | 46/34 |
| 2,152,299 | 3/1939 | Arndt | 40/125 B |
| 2,544,783 | 3/1951 | Freedman et al. | 40/126 A |
| 2,742,723 | 4/1956 | Klein | 40/126 A |

FOREIGN PATENT DOCUMENTS

| | | | |
|---|---|---|---|
| 632,509 | 11/1949 | United Kingdom | 46/34 |

*Primary Examiner*—Louis G. Mancene
*Assistant Examiner*—Wenceslao J. Contreras
*Attorney, Agent, or Firm*—Shlesinger, Arkwright, Garvey & Dinsmore

[57] ABSTRACT

An advertising leaflet has an attention-getting movable flap cut out from one of its sheets which is moved into raised position when the leaflet is opened by a slender activating strip which is cut out from the opposed sheet of the leaflet and has its free end glued to the flap.

6 Claims, 5 Drawing Figures

FLAP POP-UP FOR ADVERTISING LEAFLETS

BACKGROUND OF INVENTION

Advertising leaflets which are mass produced and are used as newspaper inserts have opened up an entirely new market for printing services. Such leaflets have used many different arrangements and formats to catch the eye and have included return envelopes, post cards, and coupons.

One of the most recent developments with regard to advertising leaflets has been the introduction of a pop-up section which provides additional impact and eye appeal by putting at the disposal of the advertiser the additional elements of dimension and motion to accentuate his advertising message. This recent development in the state of the art is described in patent application Ser. No. 717,174. The present invention is directed to an improvement in advertising leaflets having a pop-up feature.

SUMMARY OF INVENTION

Accordingly, this invention relates to media type advertising leaflets, and particularly to a new simple pop-up construction.

It is possible to produce a three-dimensional aspect in a small advertising piece, to give substantial visual impact to the advertising message.

A direct focus of attention is made to the more significant portions of the advertising with the pop-up indicator format.

Further, the use of the pop-up as an element of a three-dimensional object adds further emphasis. Movement of the element, such as a door, permits an interior view of the article.

These movements and shapes, which will be wholly unexpected by the reader of the pamphlet, will significantly increase his interest, and, with the combination of movement, color contrast, and three-dimensional display, directly focus attention.

The visual impact will substantially increase the percentages of persons who will recall the advertisement and its advertising message.

Further, this is accomplished in a leaflet that may be as small as two sheets and in which no additional insert pieces or construction are required. The required elements are cut out from each of two adjacent sheets on high speed printing and forming equipment currently available.

These and other advantages of this invention wil become apparent with the following description.

DESCRIPTION OF THE INVENTION

Figure 1:
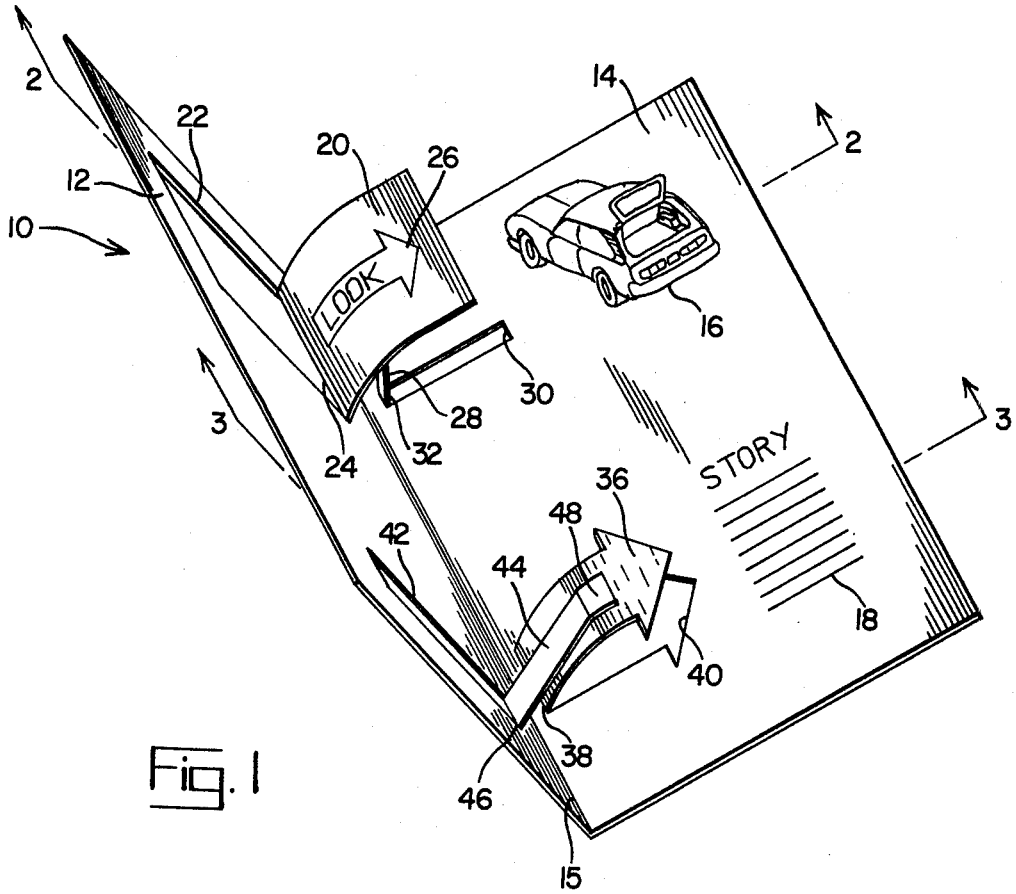
FIG. 1 is a perspective view of the pamphlet showing it in its open position with the pop-up elements in raised position.

Referring particularly to the drawings, FIG. 1 shows the opened leaflet assembly generally indicated at 10 which has two opposed sheets 12 and 14 on which advertising material is printed. The printing will include figures such as figure 16, and descriptive material such as 18, both shown on sheet 14.

A pop-up flap 20 is cut out from sheet 12 at 22 and is supported in a cantilever fashion at connecting section 24. Special printing material 26 is contained on the flap and this is correlated with the advertising material which will be disposed immediately opposite it on page 14, as shown in FIG. 1, so that particular attention is drawn to that section, in this case, the figure of an automobile 16.

A slender flap-moving member 28 is cut out from page 14, as indicated at 30, and has a connecting section 32, about which it moves. The manner in which it operates can best be seen in FIG. 2, which shows that the flap-moving member has an end piece or section 34 fastened to the under surface of flap 20. Preferably, the end section 34 is glued to the flap.

When the pages 12 and 14 are moved apart, as shown in FIG. 1, page 12 will act to move flap 20 upwardly with it. However, the flap 20 is restrained by the slender flap-moving member 28, so that when the pages are opened, flap 20 assumes a raised position above page 14.

The flap member will stand out by itself as a separate object. Consequently, what is printed on it and its shape and outline will be the immediate object of focus and can be used to direct attention to material on the other page, or to advertising material that is printed on the flap itself.

This construction brings the advantages of the pop-up to an ordinary two-page leaflet, in which the cut out elements are supplied from the opposed sheets of the leaflet, with no need for additional elements.

Another pop-up arrangement is shown as part of the lower section of the leaflet assembly 10 of FIG. 1. In this instance, a specially configured arrow-shaped flap 36 is cut out from the page 14 and is supported at the connecting sections 38. The flap, since it is cut from the page 14, will leave an opening with the outline of the arrow as indicated at 40.

Figure 3:
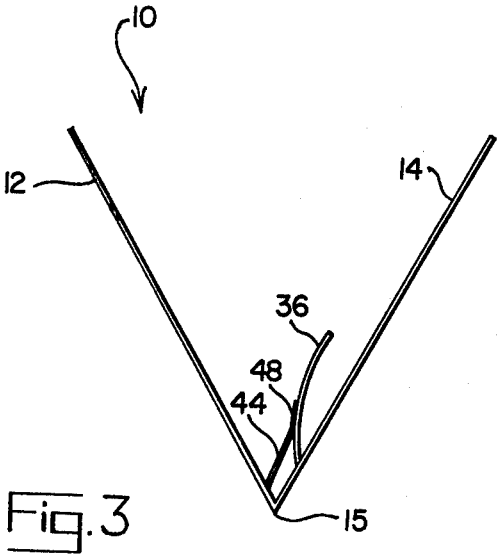
FIG. 3 is a sectional view of FIG. 1 along line 3—3.

The top sheet 12 is cut as shown at 42 to provide the slender flap-moving member 44 which is supported to sheet 12 by connecting section 46. The free end of the flap-moving member 44 is preferably glued to the arrow-shaped flap 36 at section 48. FIG. 3 shows an end view of the arrangement of this type of pop-up.

With respect to both of these pop-up arrangements, it should be noted that the two sheets of the leaflet when folded together in a flat position will move both members back into the planes from which they are cut. The relative lengths of the member from the fold line to the connecting section, and the lengths of the elements from the connecting sections to the point of joinder between the flap and flap-moving member are selected so that the sum of the lengths in each sheet from the fold line to the point of juncture of the flap and the flap-moving member are the same.

It should also be noted that the connecting sections which support the flap, and the flap-moving member are located relatively close to the fold line 15, and preferably are less than one-third of the width of the sheet from the fold line. The elements can be varied to some degree to produce varying effects in the overall pop-up scheme. For example, it may be desirable to have a flap which is disposed in a plane somewhat parallel to the sheet, or it may be desirable to have the flap extend upwardly at a relatively large angle to the lower page.

In either event, this would be left to the discretion of the advertiser and the type of use to which the pop-up element, in this instance the flap member, would be used.

The arrangement of this invention provides a great deal of flexibility for the advertiser, in that he can use the flap member to represent an object, possibly even the shape of his product, or as a particular focusing element such as the arrowhead configuration of flap 36 of FIG. 1.

The flap itself can also be employed as a special coupon that would be readily removable. In this instance, to assist in removal, a line of perforation could be provided across the connecting section which supports the flap.

It is also possible to combine the flap and flap-articulating member in a one piece member, all of which is cut out from only one of the sheets. For example, referring to the arrowhead configured flap 36 of FIG. 1, it would be possible to cut the flap-moving member from within the flap itself and to glue its lower or free end of the sheet 12. In this type of arrangement, all of the die cutting would take place on either one or the other of the two adjacent sheets of the leaflet.

These two-page leaflets are produced on high speed printing and forming machinery. A web of paper is fed through a series of printing presses in which the complete printing for the finished product is performed. Glue is applied the web in the following stage for joining the flap and flap-moving member, and then the flap and flap-moving member outlines are die cut. The web is then folded to bring the two adjacent sheets into superposed relation, and the final operation, a transverse cut of the web to sever successive leaflet pieces is made.

Figure 2:
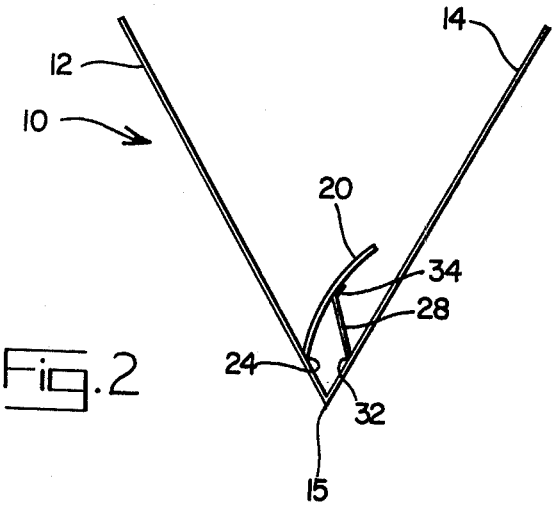
FIG. 2 is a sectional view of FIG. 1 along line 2—2.

In addition to the attention focusing capabilities of this type of design as shown in FIGS. 1 to 3, it is also possible to particularly emphasize a feature of an article to be sold. This is best illustrated in FIGS. 4 and 5.

The pop-up assembly generally indicated at 50 is of the type shown and illustrated in patent application Ser. No. 717,174. The use of the cut-out flap and its particulated movement on opening of the leaflet emphasize the particular feature of a given product.

Figure 4:
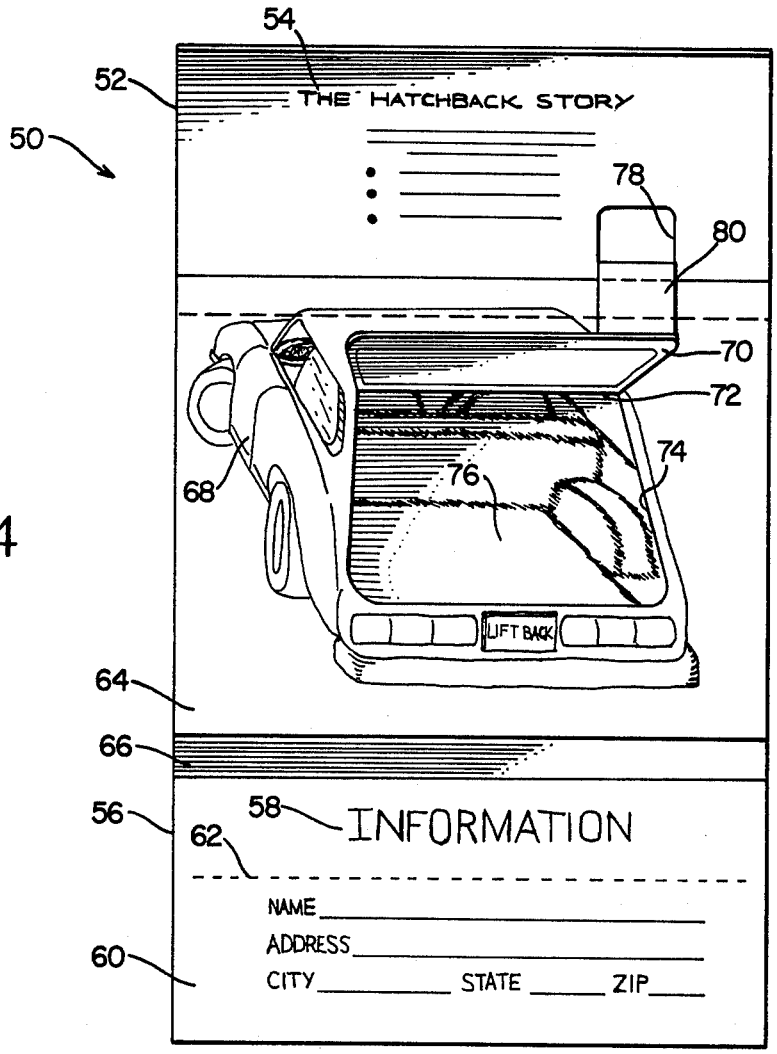
FIG. 4 is a plan view of another modification of another type of leaflet showing the pop-up as an element of an article.
Figure 5:
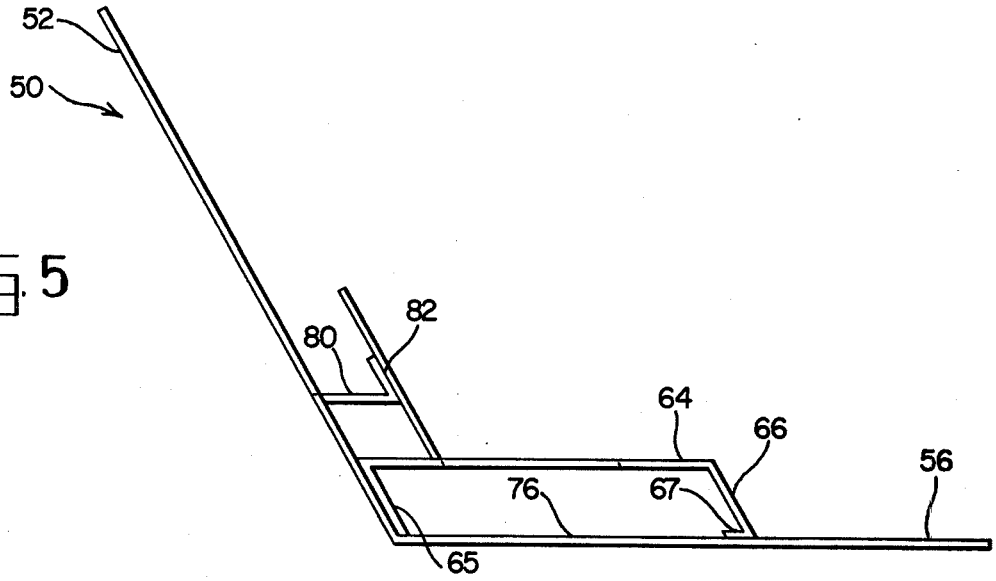
FIG. 5 is a side view of the leaflet assembly of FIG. 4.

Referring to FIGS. 4 and 5, the leaflet assembly generally indicated at 50, has an upper sheet 52 with descriptive material 54.

The lower sheet 56 has general information generally indicated at 58 printed thereon adjacent the end, and at the end thereof has a return address or coupon section 60 which is separable along the perforated line 62.

A central pop-up section similar to the type illustrated in patent application Ser. No. 717,174 is disposed between the sheets 52 and 56. It has an upper flat sheet 64 and a side section 65 which is glued to the sheet 52 along the fold line between sheets 52 and 56. An opposite side panel 66 supports the upper flat panel 64 at one edge, and at its other edge is held in position on sheet 56 by the piece 67 which is glued thereto.

The upper flat sheet 64 has a figure of an automobile 68 printed thereon and has a movable cut-out flap 70 which depicts the hatchback type of rear door. It is foldable about line 72 which can be made as a weakened line or crease to facilitate movement of the flap 70 in an upward direction when the sheets 54 and 56 are opened.

As the sheets 52 and 56 are opened, sheet 64 will rise in an upwardly moving horizontal plane, and simultaneously the flap member 70 will move up and away from its position in the plane of panel 64 leaving the opening 74 through which an interior view of the automobile 68 is given on covered section 76 of the lower sheet 56.

The flap 70 which is printed to represent the rear door of the automobile 68 is moved upwardly by the flap-moving member 80 which is cut out from sheet 52 as indicated at 78. Its free end 82 is glued to the flap 70.

This modification gives added versatility to product advertising. The ability to depict a movable part or special feature of product, to which the eye is immediately directed gives a clear cut superiority over flat one-dimentional advertising pieces.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the appended claims.

What I claim is:

1. An advertising pop-up assembly, comprising:

(a) two rectangular paper sheets joined along a fold line (b) at least one of the sheets having advertising material on its inside face (c) a direction indicating element partially cut from and integral with and projecting from one of the sheets and extending outwardly from the fold line with its free end disposed immediately adjacent the advertising material and movable from the plane of the sheet (d) a partially cut out elongated relatively thin articulating element extending substantially in the same direction as and integrally connected at one end to the central section of the direction indicating element, and (e) the articulating element having its other end connected to the other sheet at a point spaced from the fold line such that when the two sheets are parted the articulating elements pulls on the direction indicating element and brings it to a position above and adjacent the advertising material to direct the reader's attention thereto.

2. The advertising pop-up assembly as set forth in claim 1, wherein:

(a) the direction indicating element is integrally connected to the said one sheet at a point which is spaced less than one-third the width of the sheet from the fold line.

3. The advertising pop-up assembly as set forth in claim 1, wherein;

(a) the direction indicating element itself has an outline conforming to a familiar shape.

4. The advertising pop-up assembly as set forth in claim 1, wherein:

(a) the direction indicating element and the articulating element are each partially cut out from the sheet with which they are associated and normally lie in the plane of such sheets.

5. The advertising pop-up assembly as set forth in claim 1, wherein:

(a) the end of the articulating element integral with the direction indicating element is connected thereto by adhesive.

6. The advertising pop-up assembly as set forth in claim 1, wherein:

(a) the length of and the points at which the ends of the articulating element are respectively connected to the direction indicating element and the other sheet are such that the direction indicating element is raised to a position above the advertising material when the two sheets are opened.

* * * * *